US005848536A

United States Patent [19]

Dodge et al.

[11] Patent Number: 5,848,536

[45] Date of Patent: Dec. 15, 1998

[54] SELF CONTAINED MARINE AIR CONDITIONER

[76] Inventors: David Dodge, 18280 Coral Isles Dr., Boca Raton, Fla. 33498; James Harper, 9432 Yearling Dr., Lake Worth, Fla. 33467; Frank Marciano, 22681 SW 53 Ave., Boca Raton, Fla. 33433

[21] Appl. No.: 897,632

[22] Filed: Jul. 21, 1997

Related U.S. Application Data

[60] Provisional application No. 60/038,997 Feb. 26, 1997.

[51] Int. Cl.[6] ..... B63B 25/26; F25D 17/06; F25B 27/00

[52] U.S. Cl. ..... 62/240; 62/286; 62/238.6; 62/428

[58] Field of Search ..... 62/240, 90, 238.6, 62/279, 305, 411, 412, 428, 73, 285, 286

[56] References Cited

U.S. PATENT DOCUMENTS

| | | | |
|---|---|---|---|
| 3,102,397 | 9/1963 | Trucchi | 62/240 |
| 3,111,013 | 11/1963 | Ammons | 62/240 |
| 3,760,601 | 9/1973 | Bunten | 62/240 |
| 3,822,566 | 7/1974 | Lowi | 62/435 |
| 3,888,090 | 6/1975 | Meyer | 62/240 |
| 4,967,569 | 11/1990 | Machen et al. | 62/240 |
| 4,977,750 | 12/1990 | Metcalfe | 62/77 |
| 5,237,832 | 8/1993 | Alston | 62/200 |
| 5,377,503 | 1/1995 | Reedy et al. | 62/326 |
| 5,666,813 | 9/1997 | Brune | 62/90 |
| 5,697,227 | 12/1997 | Bruce et al. | 62/285 |

OTHER PUBLICATIONS

"Cabin Mate™" brochure, Marine Air Systems, Inc. Mar. 1997.

Vector Rotary™ brochure, Marine Air Syetems, Inc. Dec. 1996.

*Primary Examiner*—William Doerrler

*Attorney, Agent, or Firm*—Nixon & Vanderhye P.C.

[57] ABSTRACT

A marine air conditioner (which may also be used as a heat pump) has a low volume to cooling capacity ratio, and high efficiency. A blower is connected to a shroud, and within the shroud are a water cooled tube-in-tube condenser coil and a raised lance fin evaporator coil. The condenser coil is mounted between the evaporator coil and the blower so that air is drawn past the evaporator coil, then past the condenser coil, and then discharged by the blower. The shroud and blower are mounted, along with a rotary compressor connected to the coils by refrigerant lines, in a condensate drain pan having side walls of 1.5 inches or more in height and a plurality of widely spaced drain plugs or fittings. The cooling water inlet and outlet for the condenser coil pass through a wall of the shroud, and the inlet is connected to a water pump below the water line of the boat in which the condensate pan is mounted.

18 Claims, 8 Drawing Sheets

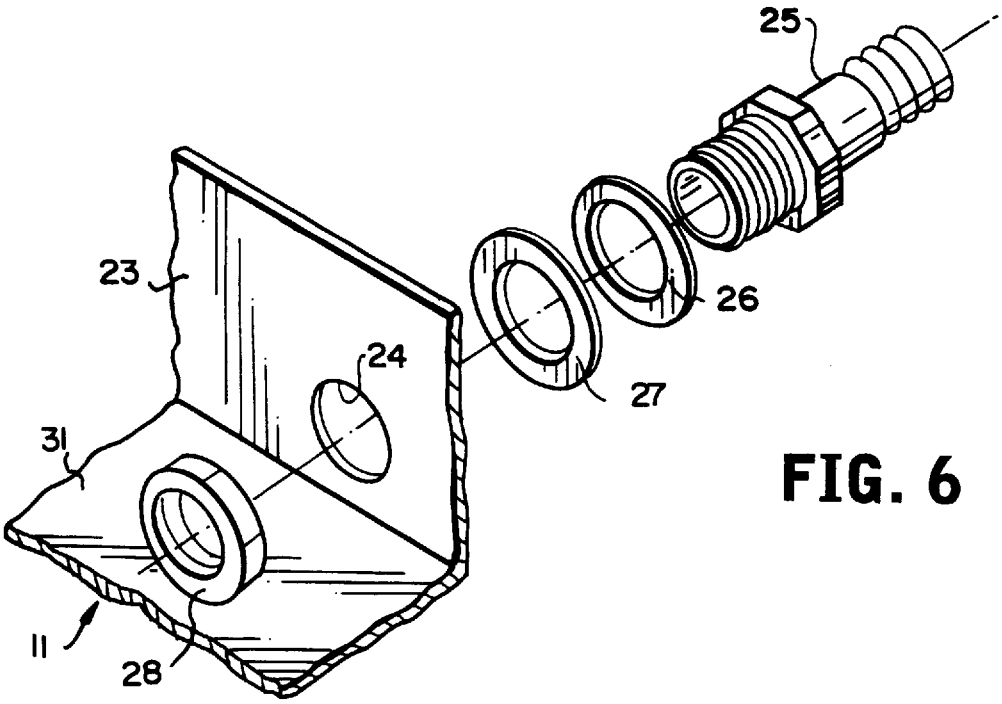
FIG. 6
FIG. 7
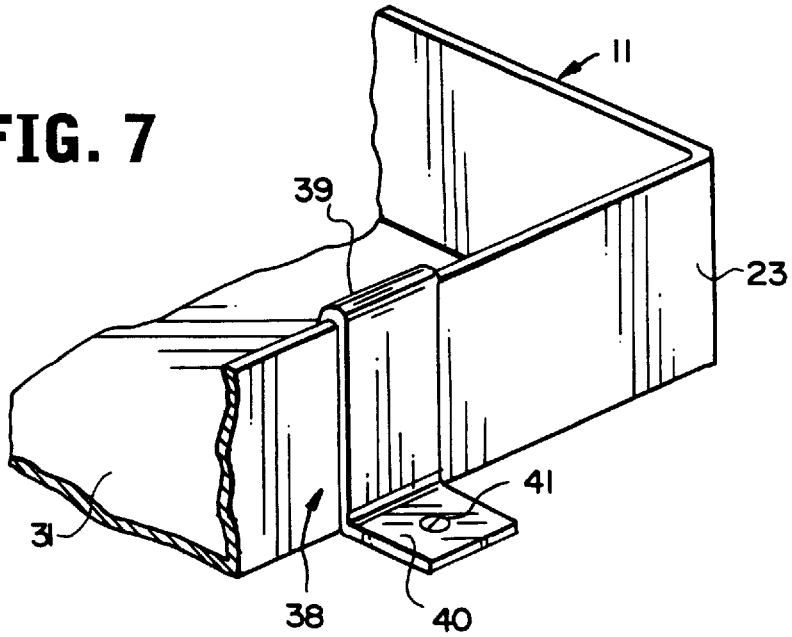

SELF CONTAINED MARINE AIR CONDITIONER

CROSS-REFERENCE TO RELATED APPLICATION

This application claims the benefit of provisional application Ser. No. 60/038,997 filed Feb. 26, 1997.

BACKGROUND AND SUMMARY OF THE INVENTION

On boats more than forty feet long marine air conditioners are fairly common especially where the boat is often used in hot climates. However marine air conditioners have not been common in somewhat smaller boats, such as in the twenty five foot long range. In the past there have been difficulties in designing and utilizing effective air conditioners that have the attributes necessary to work in the marine environment yet have the size, flexibility, and efficiency to be utilized in relatively small boats.

According to the present invention a marine air conditioner is provided that is ideally suited for use with smaller boats (e.g. in the twenty five foot range), The mariner air conditioner of the invention is a self contained unit that not only is easy to ship and install, but it is small enough to fit comfortably in relatively small boats (e.g. beneath a settee, in a closet, or under a v-berth) yet has sufficient capacity and efficiency to effectively cool the craft in which it is installed.

The marine air conditioner according to the invention uses a high efficiency rotary compressor, and produces nearly one-half ton of cooling. It utilizes a cupronickel condenser coil and a raised lance fin evaporator coil. A built-in stainless steel drain/base pan, which is readily mounted in many marine environments merely using mounting brackets, is deep (e.g. one and three quarters inch deep) and preferably has multiple condensate drain locations for maximum flexibility and ease of installation. The blower position is adjustable to blow either horizontally or vertically, again providing maximum flexibility and ease of installation. The power consumption is only about 400 wafts at 115 volts, and the current draw is only about 3.9 amps at 115v, allowing extended operation on inverter applications.

The marine air conditioner according to the invention also is preferably packaged in a kit containing all of the components necessary for effective installation. The kit includes a sea water pump, strainer, through-hull fittings, hoses, grilles, ducts, controls, and electrical connections. The weight of the self contained air conditioner can be less than forty pounds, and not including the blower overhang and condenser hookup takes up a volume of only about a cubic foot.

While the marine air conditioner according to the invention is particularly effective for boats in the twenty five foot range, the basic design according to the invention is highly advantageous for almost any size boat. Because of the particular manner in which the operative components are mounted—i.e. in a deep condensate pan, and with the condenser coil within the same shroud as the evaporator coil and between the evaporator coil and the blower—the air conditioner according to the invention has a very low volume to cooling capacity ratio, and high efficiency.

The shroud of the invention is a sealed (substantially air tight) air plenum between the evaporator coil and the blower, typically made out of corrosion resistant metal, such as aluminum or galvanized or stainless sheet steel, and requires that air pass through it before it reaches the blower.

The condenser mounted inside the evaporator shroud is a key component for making the unit small. This area is typically wasted area, and if the condenser were not mounted within the shroud it would have to be elsewhere on the unit. Additional benefits of this location (particularly with the condenser coil between the evaporator coil and the blower) are:

- Because refrigerant gas is cooled by the air flowing over the condenser, even if water is not flowing through the condenser, a high pressure switch is not required;
- Reduced head pressure—Having the high pressure refrigerant hot gas and liquid in the outer tube of the water cooled condenser coil in contact with the cold air leaving the evaporator coil has the effect of increasing the efficiency of the condenser coil, and decreases the condensing pressure of the refrigerant. This makes the air conditioner more efficient by increasing the net cooling capacity of the air conditioner due to the increased mass flow of refrigerant through the compressor.
- Increased sub cooling—Having the high pressure refrigerant hot gas and liquid in contact with the cold air has the effect of increasing the liquid subcooling beyond that which would normally be achieved. The water cooled condenser coil is more efficient with cold air being drawn across it.
- Increased gross cooling capacity—The effect of increasing the subcooling of the liquid beyond which would normally be achieved increases the gross cooling capacity of the air conditioner. This is due to the lower enthalpy of the refrigerant entering the evaporator.
- Increased Dehumidification—The increased gross sensible and latent cooling capacity of the air conditioner results in a lower air temperature and humidity ratio leaving the evaporator coil thus, increased moisture removal and the dehumidification potential of the air conditioner is increased. Increased levels of dehumidification are important in the marine air conditioning industry because the inherent geographical location of the installations put them in high relative humidity areas.
- Reheat—The air leaving the indoor coil is reheated as it flows across the condenser coil, absorbing heat from the hot gas and liquid refrigerant. The amount of heat that is absorbed by the air makes the net cooling capacity of the air conditioner equal to the net cooling capacity of the unit without the condenser in the shroud. The amount of moisture removed from the space is increased when the air is reheated while the net sensible cooling capacity is the same.

According to one aspect of the present invention, a low volume (space taken-up) to cooling capacity ratio, highly efficient, marine air conditioner—for mounting in a boat having a hull—is provided. The air conditioner may be used for cooling only, or may have conventional valves associated therewith to allow it to also be used for heating (i.e. a heat pump). The air conditioner according to the invention preferably comprises the following components: A blower including blower blades and a motor for rotating the blower blades to draw air in a first direction, and expel the air in a second direction. A shroud mounted adjacent the blower. An evaporator coil (e.g. a raised lance fine type) positioned near the blower within the shroud so that air drawn by the blower in the first direction passes past the evaporator coil. A condenser coil (e.g. a cupronickel water-cooled tube-in-tube type, including an inner tube and an outer tube) operatively positioned within the shroud between the evaporator coil and the blower so that air drawn by the blower in the first direction passes through the evaporator coil, then passes past the condenser coil, and then into the blower. And, a compressor (e.g. a rotary one) operatively connected to the evaporator coil and the condenser coil.

A cooling water inlet may be provided to, and a cooling water outlet provided from, the inner tube of the condenser coil, the inlet and outlet passing through the same wall of the shroud. The compressor is positioned outside the shroud and is connected by refrigerant lines to the outer tube of the condenser coil, and to the evaporator coil.

Preferably, a condensate pan having a floor with a given surface area is provided, the blower blades, compressor, and shroud mounted substantially completely within a volume defined by the given surface area, above the condensate pan floor. Preferably the condensate pan has a depth of about 1.5 inches or more (e.g. about 1.75 inches), and has a plurality of widely spaced condensate drain plugs or fittings; also the floor given surface area is desirably substantially rectangular.

The marine air conditioner of the invention (e.g. the condensate drain pan) is typically mounted on a substantially horizontal surface of the boat, and is connected to a sea water pump and conduits connected to the condenser coil inlet and outlet. The sea water pump is disposed in the inlet conduit and the inlet conduit penetrates the hull. The outlet conduit also penetrates the hull, so that water from a body of water in which the boat is disposed is pumped by the pump through the inlet conduit and the condenser coil, and then returns to the body of water through the outlet conduit. The boat has a water line, and preferably the outlet conduit penetrates the hull above the water line, and the inlet conduit penetrates the hull below the water line, and the pump is mounted below the water line.

Typically, the compressor is mounted on a pedestal, which is turn is mounted on the condensate pan floor, whereas the shroud may be mounted substantially directly on the condensate pan floor. The blower is mounted in a housing distinct from, but connected to, the shroud, the blower housing including an outlet duct ring through which air moves in the second direction under the force of the blower blades, the outlet duct ring positioned so as to be adjustable between at least first and second positions at least about 90° apart.

According to another aspect of the invention, a marine air conditioner (which may be a heat pump) is provided comprising the following components: A blower including blower blades and a motor for rotating the blower blades to draw air in a first direction, and expel the air in a second direction. An evaporator coil positioned near the blower so that air drawn by the blower in the first direction passes past the evaporator coil. A condenser coil. A compressor operatively connected to the evaporator coil and the condenser coil; and a condensate pan having a floor with a given surface area, the blower blades, compressor, evaporator coil and condenser coil all mounted substantially completely within a volume defined by the given surface area, above the condensate pan floor. The details of the unit preferably are as described above.

It is the primary object of the present invention to provide a low volume to cooling capacity ratio, high efficiency, marine air conditioner. This and other objects of the invention will become clear from a detailed description of the invention, and from the appended claims.

BRIEF DESCRIPTION OF THE DRAWINGS

FIG. 6 is a detail perspective view showing an exemplary installation of a condensate drain in the base/condensate pan of the air conditioner of FIG. 1;

FIG. 7 is a detail perspective view of an exemplary manner of mounting the base/condensate pan of FIG. 1;

DETAILED DESCRIPTION OF THE DRAWINGS

Figure 1:
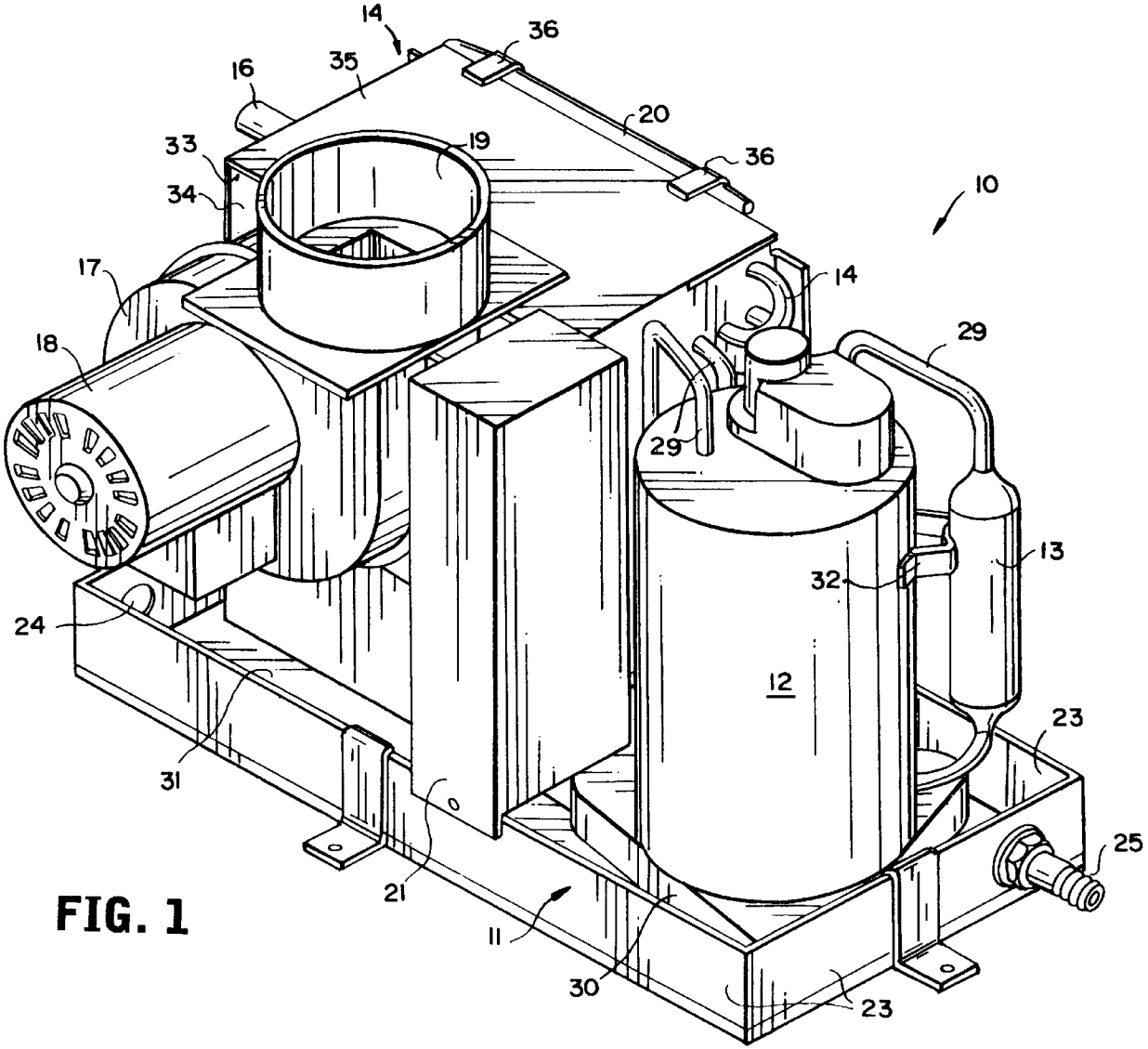
FIG. 1 is a top perspective view of a self contained marine air conditioner according to the invention.

An exemplary self contained marine air conditioner unit according to the invention is shown generally by reference numeral 10 in FIGS. 1–5. Some of the main components (seen most clearly in FIGS. 1–4 and 10) include the base/condensate pan 11, a rotary compressor 12, a suction accumulator 13, an evaporator coil 14, sea water inlet 15 and outlet 16 to an internal condenser coil (see 50 in FIG. 5), the coils 14, 50 within a shroud 35 (see FIGS. 10–12), a blower 17 having blower blades 17' (FIG. 10) in a housing, a blower motor 18, a duct ring 19, an air sensor 20, and an electrical box 21 for the circuitry 22 of FIG. 8.

The base/condensate pan 11 preferably is of stainless steel or like strong, corrosion resistant, material, and supports the other components in any suitable manner (such as pedestals, connection of components to the pan walls 23, etc.). The pan is also deep, at least about 1.5 inches, e.g. about one and three quarters inches (i.e. the interior height of each wall 23 is about 1¾"), and preferably at least two widely spaced drain openings (with fittings 25) or plugs 24 (see FIG. 1) are provided for condensate. FIG. 6 shows one exemplary manner in which a condensate drain fitting 25 is mounted in a drain opening 24 in a wall 23. The drain fitting 25 may be, for example, a conventional PVC fitting ½"" HB×½" MPT. Fitting 25 cooperates with a solid washer 26 and liquid seal washer 27 on the outside of the wall 23, and is held to the base pan 11 by locking nut 28. Two or more remotely spaced openings/plugs 24 are provided to allow flexibility of installation.

Figure 10:
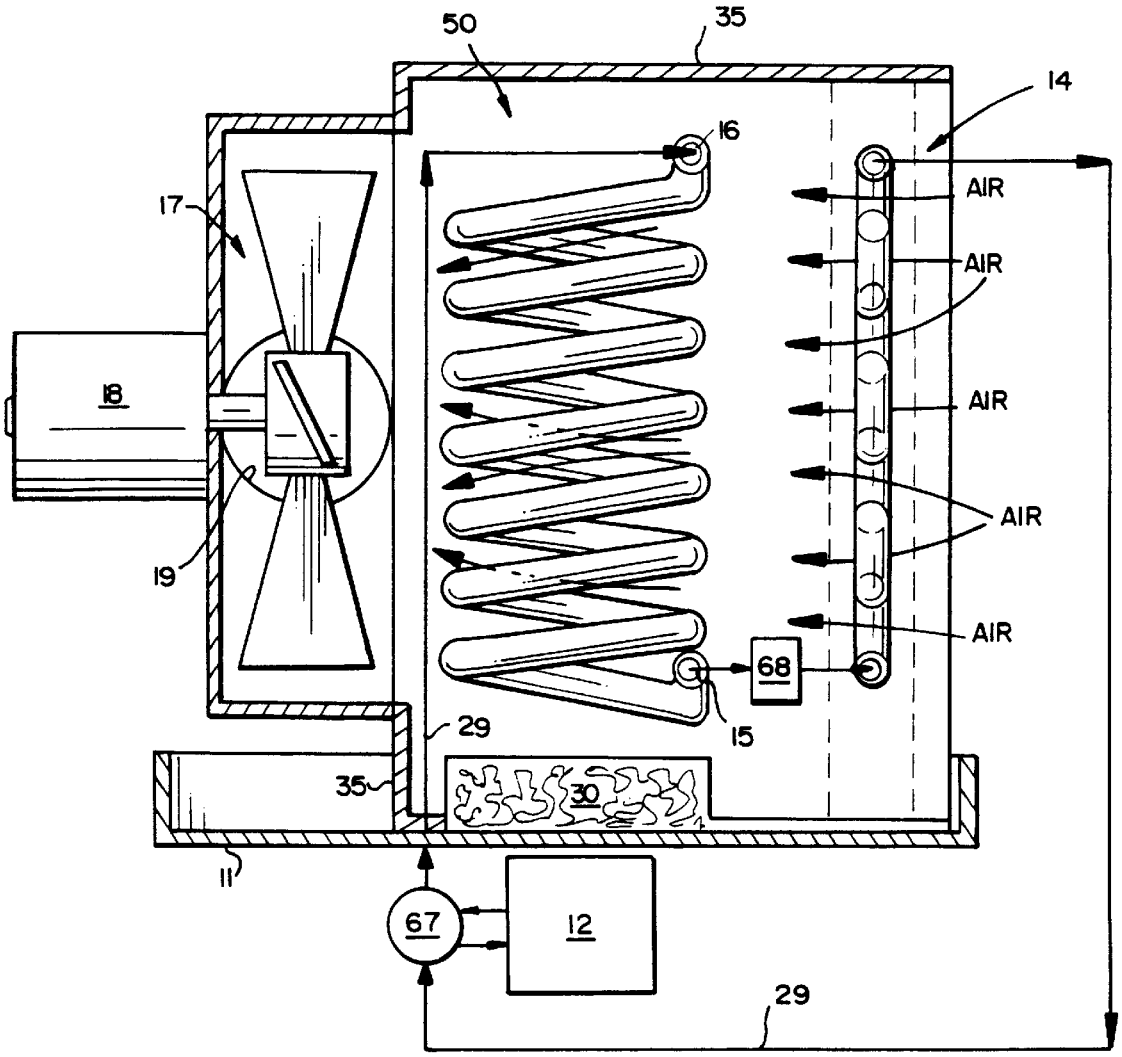
FIG. 10 is a side view, partly in cross section, partly in elevation, and partly schematic, or an exemplary marine air conditioner according to the invention showing the particular relative mounting of the blower, shroud, condenser coil, and evaporator coil, thereof.

The compressor 12 is preferably a high efficiency rotary compressor, such as a Tecumseh Rotary, although any suitable compressor may be utilized, depending upon the size and configuration of the unit 10. Compressor 12 is connected to the conventional suction accumulator 13, raised lance fin designed evaporator coil 14, and cupronickel condenser coil (connected to inlet 15 and outlet 16—see 50 in FIG. 5), by conventional conduits 29 for transporting refrigerant, and the like, in a conventional manner. Preferably compressor 12 is mounted on a pedestal 30 which is supported on the floor 31 of the pan 11, and the accumulator 13 is mounted by a bracket 32 directly to the compressor 12. The shroud 35, with the coils 14, 50 therein, is preferably either mounted on its own pedestal (not shown), or directly to the floor 31 of the pan 11, as seen in FIG. 10. Or the shroud 25 may be screwed to the electrical box 21, which in turn is affixed to the floor 31, or to the side walls 23, of the pan 11.

The conventional blower 17 is powered by conventional electric motor 18, to discharge cooled air through the duct ring 19. For flexibility and ease of installation the blower 17 is preferably mounted so that the duct ring 19 may be oriented either vertically—as illustrated in solid line in FIGS. 1–4—or horizontally—as illustrated in dotted line in FIG. 3. The orientation of the blower 17 is changed merely by unscrewing screws 33, rotating the square mounting plate 34 supporting the blower housing 17 ninety degrees about an axis through the motor 18 (which is coaxial with the fan shaft of blower 17), and reconnecting the square plate to the condenser/evaporator shroud 35 using the screws 33.

FIG. 10 most clearly, and schematically, shows the relative positions between the blower blades 17', the evaporator coil 14, and the condenser coil 50. The evaporator coil 14 is in heat exchange relationship with the interior space to be cooled (or heated if the unit 10 is operated as a heat pump), while the condenser coil 50 is in heat exchange relationship with a cooling fluid, preferably the water of the body of water in which the boat 54 is floating (see FIG. 5). Refrigerant compressed by the compressor 12 is at elevated temperature passes through a conventional reversing valve 67 (see FIG. 10) through refrigerant lines 29 to the outer tube of the tube-in-tube condenser coil 50. The heat exchange between the refrigerant and the air passing (under the influence of blower blades 17') over the coil 50 reduces the refrigerant condensing pressures, increases refrigerant subcooling, increases gross cooling capacity, increases dehumidification capacity, and somewhat reheats the air (which has been cooled by passing over evaporator coil 14). The subcooled liquid refrigerant proceeds through the condenser coil 50, through a conventional expansion device 68 (see FIG. 10) which meters the refrigerant to the evaporator coil 14. The refrigerant evaporates in the coil 14, passes through the conventional reversing valve 67, and back to the suction line (e.g. through accumulator 13) 29 of the compressor 12.

Figure 12:
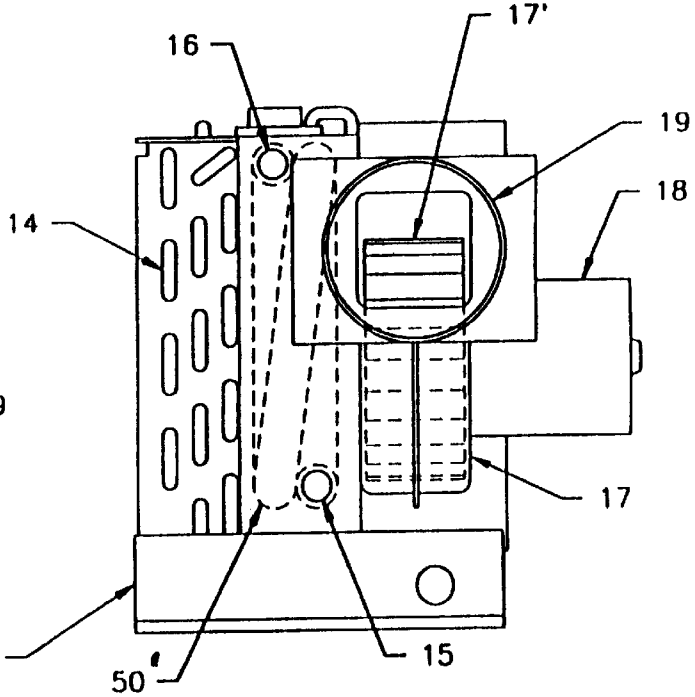
FIG. 12 is an end view of the embodiment of FIG. 11.
Figure 11:
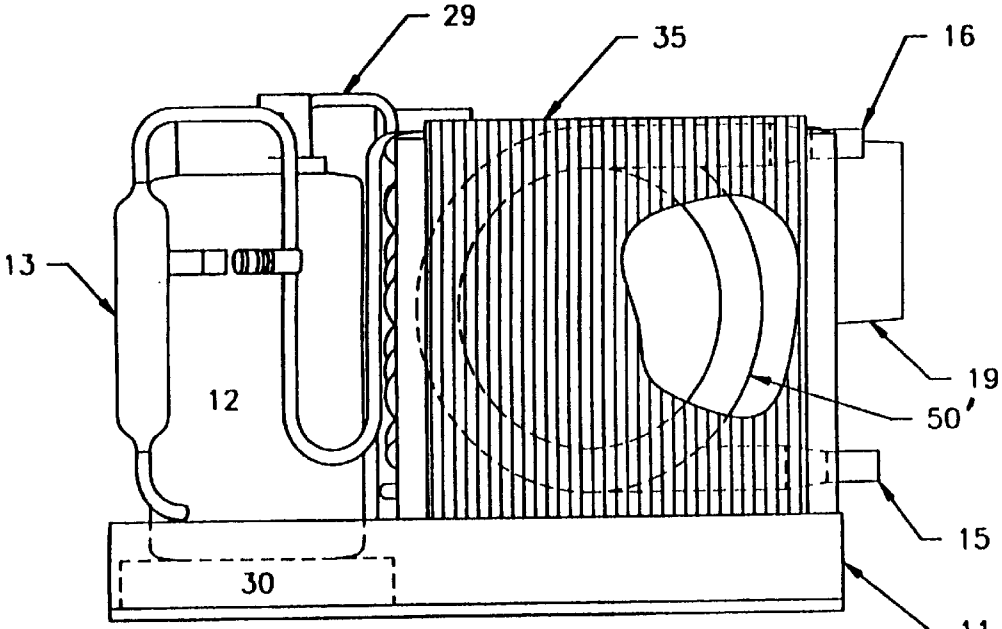
FIG. 11 is a side view, with a part of the shroud cut away for clarity of illustration, of a slightly different embodiment of the exemplary marine air conditioner illustrated in FIG. 10.

In FIG. 10 the coil 50 is shown spiralled about a generally vertical axis. In the embodiment of FIGS. 11 and 12 the condenser coil 50' is shown with a more desirable orientation, that is spiralled about a generally horizontal axis, and having the orientation with respect to the evaporator coil 14 and the inlet and outlet 15, 16 as illustrated in FIGS. 11 and 12. Aside from the axis about which the coil 50' is spiraled, and the particular orientation of the condenser coil 50', the embodiment of FIGS. 11 and 12 is essentially the same as that of FIG. 10.

Figure 2:
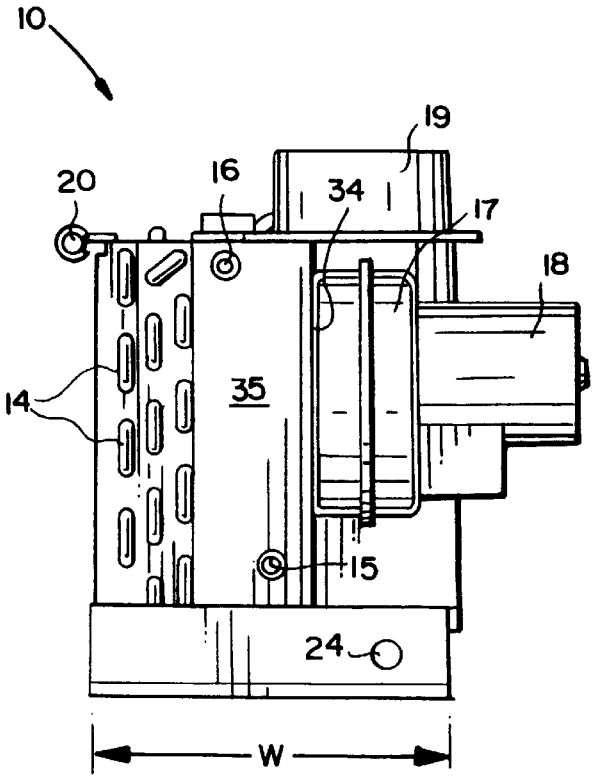
FIGS. 2 and 3 are front and side views, respectively, of the air conditioner of FIG. 1.
Figure 3:
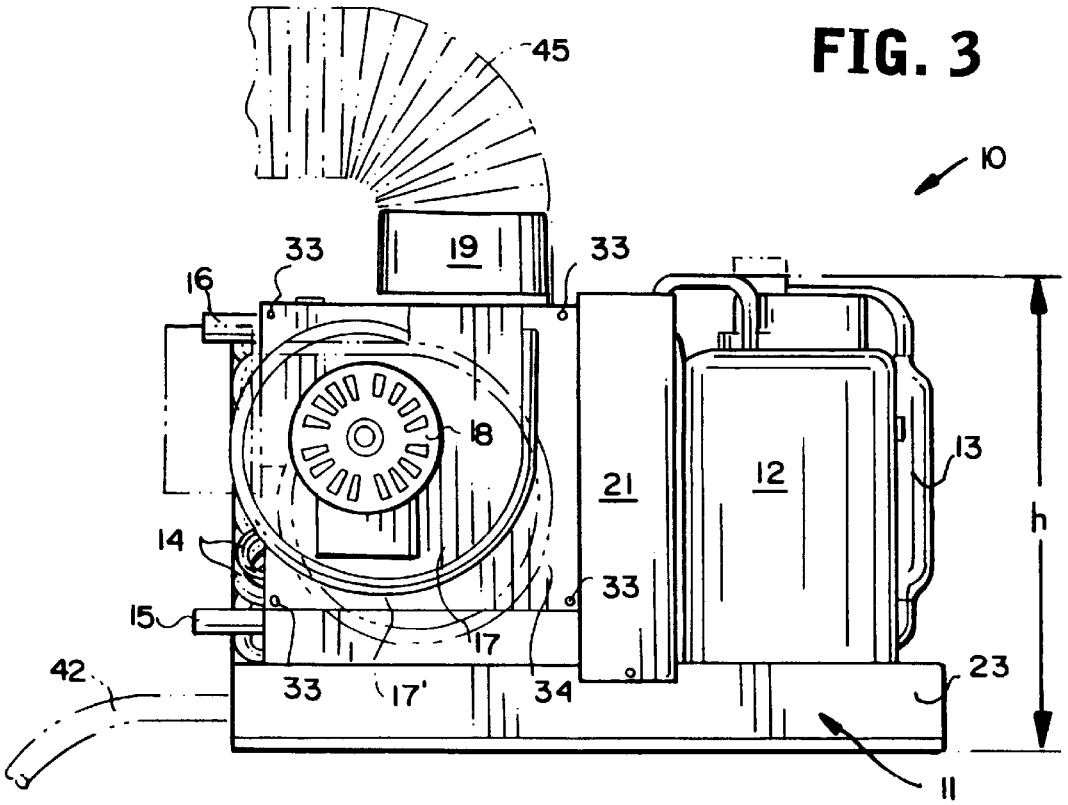

The air sensor 20 is preferably mounted by brackets 36 to the housing 35 as seen in FIGS. 1 and 2. The air sensor 20 functions to monitor the air temperature and is controlled by thermostat 63.

The pan 11 must be mounted on a firm, level, horizontal surface. Mounting is readily accomplished using the mounting brackets 38 (FIGS. 1 and 7) which preferably are made of metal and have a hooked end 39 which goes over the top of a wall 23, and an angled base 40 having an opening 41 for receipt of a nail, screw, or other fastener. Preferably four brackets 38 are provided, one for each wall 23.

A conventional condensate drain line 42 (FIGS. 3 and 4) is connected to preferably only one drain fitting 25. Drain line 42 should run downwardly from the unit 10 to a suitable drain location, preferably to a conventional sump pump (not shown). The line 42 should not be routed to the bilge. Also the condensate drain line 42 should not terminate within four feet of any outlet of engine exhaust systems, nor in a compartment housing an engine (unless line 42 is connected properly to a sealed condensate or shower sump pump).

The unit 10 is not only self contained, but is small so that it will effectively fit in many locations in a boat. The weight of the unit 10 (depending upon its cooling capacity) can be even less than forty pounds (for a twenty-five foot boat), and its dimensions are such that it occupies only about one cubic foot. For example, the width w of the unit 10 (as seen in FIG. 2) except for overhang of the motor 18 may be only about eight inches; the height h (seen in FIGS. 2 and 3) may be about eleven and ⅜ inches; and the length L (seen in FIG. 3) may be about sixteen inches.

Figure 4:
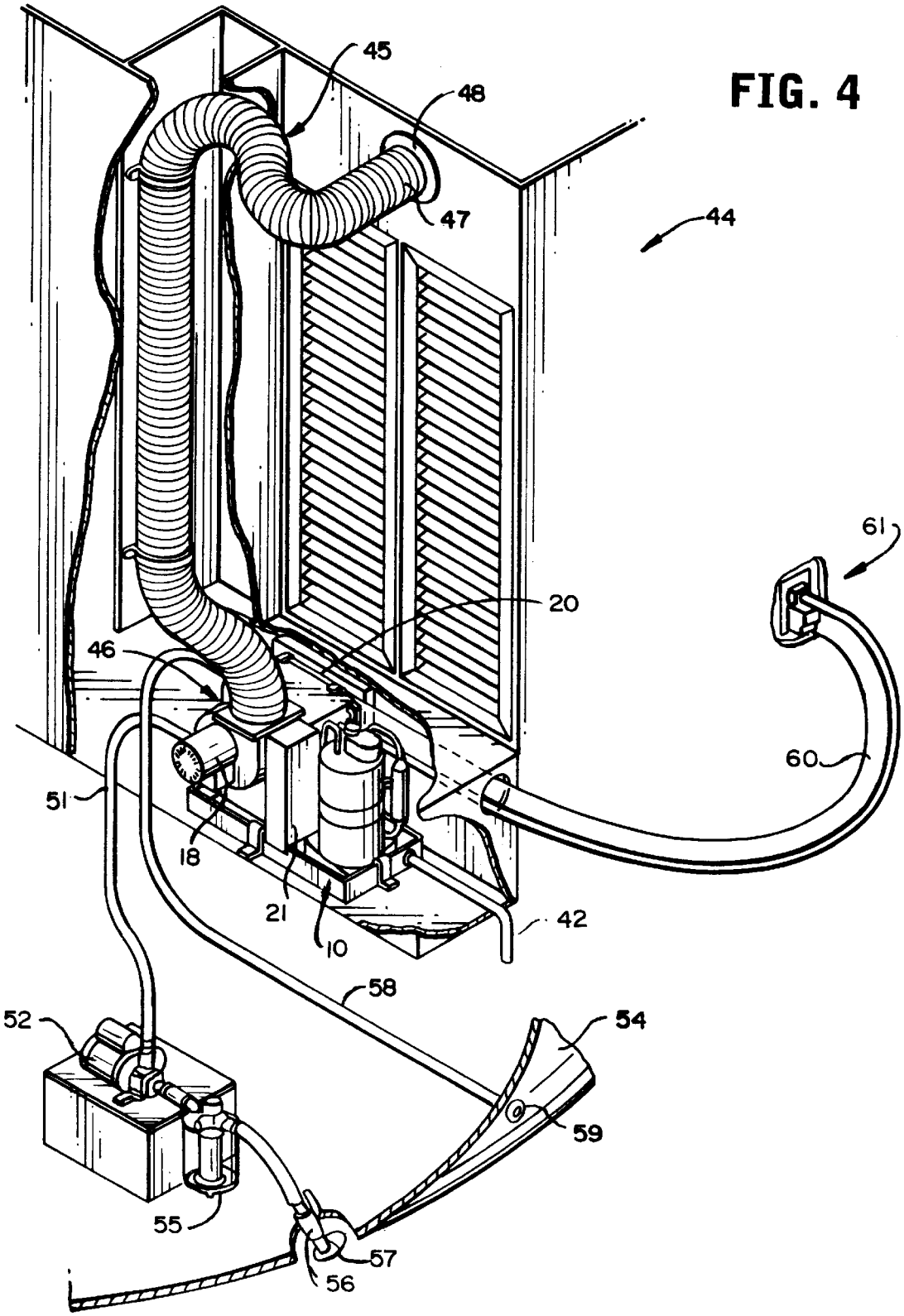
FIG. 4 is a view like that of FIG. 1 showing the air conditioner in an exemplary desirable system installation thereof, according to the invention, in a boat.
Figure 5:
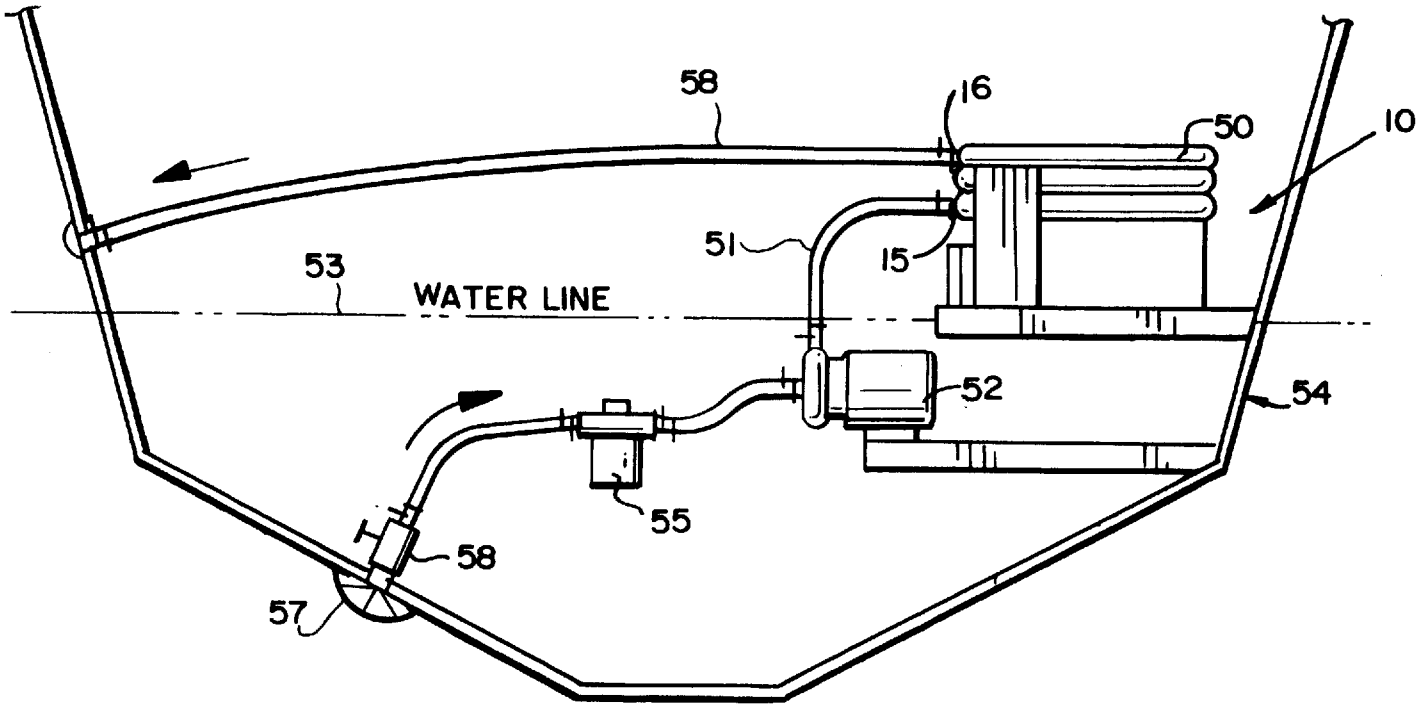
FIG. 5 is a schematic side view of the system of FIG. 4 showing orientation with respect to the boat in more detail.

FIG. 4 shows an exemplary mounting of the unit 10 in association with other components of a system 44 which allows effective utilization of the unit 10. The unit 10 should be positioned on a firm, level horizontal surface and the condensate drain line 42 should run downwardly, e.g. to a sump, as illustrated schematically in FIG. 4. The ducting, condensate drain, cooling water in and out, electrical connections, and pump placement should be made to assure easy access for routing and servicing.

The ducting in FIG. 4 includes a flexible duct 45 which is connected at one end 46 thereof to the duct ring 19, and at the other end 47 thereof to a supply air grille 48. The duct 45 should be run as straight as possible, minimizing the number of ninety degree turns. For typical conventional flexible ducts 45 one pulls back its fiberglass insulation exposing an inner Mylar duct hose, which is slid over the ring 19 or the air grille 48 until it bottoms out, and is held in place by three or four stainless steel sheet metal screws. Duct tape (not shown) is preferably wrapped around the duct 45 and ring 19 to prevent air leaks. A similar connection is made to supply air grille 48. A return air grille (not shown) is operatively associated with the inlet to blower 17. A conventional return air filter (not shown) is preferably mounted to the front of the evaporator housing 35 to remove debris from the air prior to the air being drawn by the blower across the evaporator coil 14 and associated fins.

The sea water (or other body of water in which the boat containing the unit 10 is disposed) used for cooling passes through inlet 15, through the cupronickel condensing coil 50 (seen in FIG. 5 where the shroud 35 has been removed to expose the coil 50, and seen in FIGS. 10–12) of the unit 10 to the outlet 16. As illustrated in both FIGS. 4 and 5 the inlet 15 is connected by conduit 51 to a conventional sea water pump 52. The pump 52 may be a conventional centrifugal circulating pump with a magnetically driven impeller. The pump 52 should be mounted below the water line 53 of the boat 54 unless the pump 52 is self priming. The pump 52 is connected to a sea water strainer 55, which protects the pump 52 from seaweed or other contaminants. Strainer 55 in turn is connected to a shut-off (ball) valve or sea cock 56, which connects to a speed scoop inlet 57 in the hull of the boat 54 below the water line 53.

The outlet 16 from the condensing coil 50 is connected to the conduit 58, which passes to the overboard discharge 59 above the water line 53. The entire seawater system should be installed with an upward incline from the sea cock 56 to the outlet 16, while the conduit 58 runs downwardly, without kinks in the conduit 58 (or any of the other conduits). All conduits should be connected with double stainless steel clamps, and polytetrafluoroethylene tape is preferably used on all threaded connections. All metallic parts in contact with sea water should be connected to the bonding system of the vessel 54, including the scoop inlet 57, strainer 55, pump 52, and unit 10.

Spacing allowances should be provided for all of the components of the system 44. For example the following minimum spacing allowances should be provided: six inches around the perimeter of the unit 10 in the area of the sea water and condensate drain piping 42, 51, 58; three inches of air space in front of the evaporator coil 14 for the return air intake if it is adjacent to a bulkhead; three inches of air space for the electric blower motor 18 ventilation; sufficient space around a refrigerant access (not shown) for the coils 14 to allow access; and two inches for the ring and six inches for the duct bend radius for the flexible duct 45 to get the total distance as measured from the blower 17 outlet.

The supply air grille 48 is desirably located as high as possible in the boat 54 cabin, while the unit 10 is installed as low as possible, but never in the bilge or engine room areas. The location of unit 10 should be sealed from direct access to bilge and/or engine room vapors. Installing unit 10 as low as possible (such as under a V-berth, under a dinette seat, or at the bottom of a locker), and ducting the supply air as high as possible, creates ideal air flow conditions, and prevents short or premature cycling.

Figure 8:
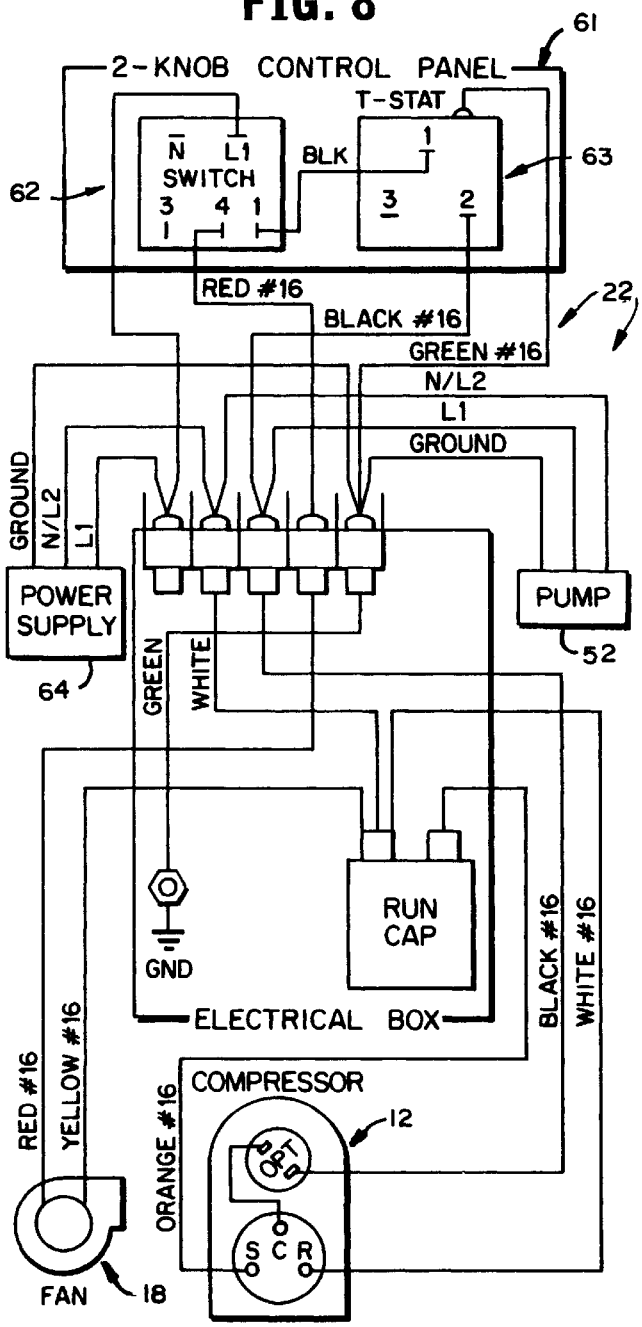
FIG. 8 is an exemplary electrical schematic of the system of FIGS. 3 and 4.
Figure 9:
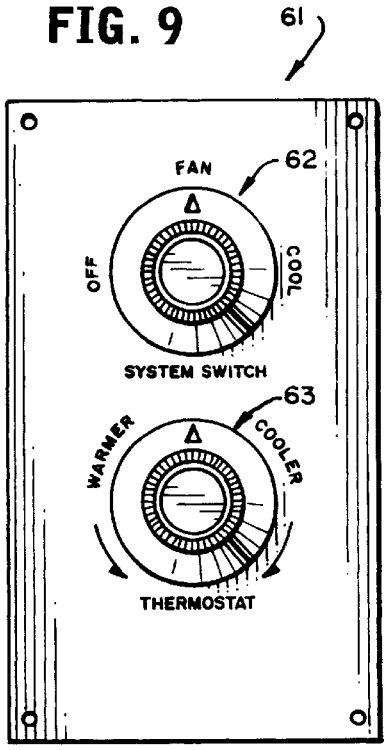
FIG. 9 is a front view of an exemplary control panel for the circuitry of FIG. 8.

FIG. 4 also shows a cap tube 60 which electrically connects the components within the electrical box 21 to a mechanical control 61, seen in more detail in FIG. 9. Control 61 preferably has a first knob 62 for on, off, and blower motor 18 only, control of the unit 10, and a second knob 63 for adjusting a thermostat. A typical electrical schematic is illustrated in FIG. 8, and is self explanatory. A fifteen amp circuit breaker is preferably used to protect the 115 VAC circuit, but a circuit breaker is not necessary for the pump 52 if the unit 10 is the only air conditioner connected to pump 52 in the boat 54 The mechanical control 61 preferably is mounted within ten feet of the unit 10. A conventional 16 AWG boat cable (not shown) should be used for the power supply 64.

The unit 10 is preferably provided as part of a kit. The kit preferably includes, in addition to the unit 10, control panel 61, pump 52, strainer 55, sea cock 56, inlet 57, discharge 59, all associated conduits (e.g. 51, 58) and related clamps, supply air grille 48, a return air grille, an air filter, plumbing fixtures, fitting 55 and related components, duct 45, and electrical terminal connectors for the circuitry 22.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A marine air conditioner, comprising:

a blower including blower blades and a motor for rotating the blower blades to draw air in a first direction, and expel the air in a second direction;

a shroud mounted adjacent said blower;

an evaporator coil positioned near said blower within said shroud so that air drawn by said blower in said first direction passes past said evaporator coil;

a condenser coil operatively positioned within said shroud between said evaporator coil and said blower so that air drawn by said blower in said first direction passes through said evaporator coil, then passes past said condenser coil, and then into said blower; and a compressor operatively connected to said evaporator coil and said condenser coil.

2. A marine air conditioner as recited in claim 1 wherein said condenser coil comprises a water-cooled tube-in-tube condenser, including an inner tube, and an annular outer tube.

3. A marine air conditioner as recited in claim 2 further comprising a cooling water inlet to and a cooling water outlet from said inner tube of said condenser coil, said inlet and outlet passing through the same wall of said shroud.

4. A marine air conditioner as recited in claim 3 wherein said condenser coil is a cupronickel condenser coil.

5. A marine air conditioner as recited in claim 3 wherein said compressor is positioned outside said shroud and is connected by refrigerant lines to said outer tube of said condenser coil.

6. A marine air conditioner as recited in claim 5 wherein said evaporator coil comprises a raised lance fin evaporator coil.

7. A marine air conditioner as recited in claim 1 further comprising a condensate pan having a floor with a given surface area, said blower blades, compressor, and shroud mounted substantially completely within a volume defined by said given surface area, above said condensate pan floor.

8. A marine air conditioner as recited in claim 7 wherein said condensate pan has a depth of about 1.5 inches or more, and has a plurality of widely spaced condensate drain plugs or fittings; and wherein said floor given surface area is substantially rectangular.

9. A marine air conditioner as recited in claim 3 wherein said marine air conditioner is mounted on a substantially horizontal surface of a boat, having a hull; and wherein said marine air conditioner is in combination with a sea water pump and conduits connected to said condenser coil inlet and outlet, said sea water pump disposed in said inlet conduit and said inlet conduit penetrating said hull, and said outlet conduit also penetrating said hull, so that water from a body of water in which said boat is disposed is pumped by said pump through said inlet conduit and said condenser coil, and then returns to the body of water through said outlet conduit.

10. A marine air conditioner in combination with a pump, and in a boat, as recited in claim 9 wherein said boat has a water line, and wherein said outlet conduit penetrates said hull above said water line, and said inlet conduit penetrates said hull below said water line, and said pump is mounted below said water line.

11. A marine air conditioner as recited in claim 7 wherein said compressor is mounted on a pedestal, which is turn is mounted on said condensate pan floor.

12. A marine air conditioner as recited in claim 11 wherein said shroud is mounted on said condensate pan floor.

13. A marine air conditioner as recited in claim 7 wherein said compressor comprises a rotary compressor.

14. A marine air conditioner as recited in claim 7 wherein said blower is mounted in a housing distinct from, but connected to, said shroud, said blower housing including an outlet duct ring through which air moves in the second direction under the force of said blower blades, said outlet duct ring positioned so as to be adjustable between at least first and second positions at least about 90° apart.

15. A marine air conditioner comprising:

a blower including blower blades and a motor for rotating the blower blades to draw air in a first direction, and expel the air in a second direction;

an evaporator coil positioned near said blower so that air drawn by said blower in said first direction passes past said evaporator coil;

a condenser coil;

a compressor operatively connected to said evaporator coil and said condenser coil;

a condensate pan having a floor with a given surface area, said blower blades, compressor, evaporator coil and condenser coil all mounted substantially completely within a volume defined by said given surface area, above said condensate pan floor, said pan having a plurality of widely spaced condensate drain plugs or fittings;

wherein said compressor is mounted on a pedestal, which is in turn mounted on said condensate pan floor;

wherein said blower includes a blower housing; and wherein said evaporator coil is mounted within a shroud connected to said blower housing, and said shroud is mounted on or to said condensate floor pan.

16. A marine air conditioner as recited in claim 15 wherein said condensate pan has a depth of about 1.5 inches or more, and wherein said floor given surface area is substantially rectangular.

17. A marine air conditioner as recited in claim 15 wherein said condenser coil is water cooled and has a water inlet and a water outlet; and wherein said condensate pan floor is mounted on a substantially horizontal surface of a boat, having a hull; and wherein said marine air conditioner is in combination with a sea water pump and conduits connected to said condenser coil inlet and outlet, said sea water pump disposed in said inlet conduit and said inlet conduit operatively penetrating said hull, and said outlet conduit also operatively penetrating said hull, so that water from a body of water in which said boat is disposed is pumped by said pump through said inlet conduit and said condenser coil, and then returns to the body of water through said outlet conduit.

18. A marine air conditioner as recited in claim 15 wherein said condenser coil is also mounted within said shroud.

* * * * *